US006767216B2

(12) United States Patent
Maegawa

(10) Patent No.: US 6,767,216 B2
(45) Date of Patent: Jul. 27, 2004

(54) CABLE REEL

(75) Inventor: Akihito Maegawa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/436,082

(22) Filed: May 13, 2003

(65) Prior Publication Data

US 2004/0002228 A1 Jan. 1, 2004

(30) Foreign Application Priority Data

Jun. 27, 2002 (JP) ..... 2002-187279

(51) Int. Cl.[7] ..... H01R 39/00
(52) U.S. Cl. ..... 439/15; 439/164
(58) Field of Search ..... 439/15, 4, 11, 439/13, 164, 501

(56) References Cited

U.S. PATENT DOCUMENTS 5,692,915 A * 12/1997 Ishikawa et al. ..... 439/164
5,707,023 A * 1/1998 Ichikawa et al. ..... 242/388
5,800,190 A * 9/1998 Ichikawa et al. ..... 439/164
5,904,585 A * 5/1999 Nishikigi et al. ..... 439/164
5,944,543 A * 8/1999 Tanaka et al. ..... 439/164
5,975,931 A * 11/1999 Ishikawa ..... 439/164
6,019,621 A * 2/2000 Sugata et al. ..... 439/164
6,343,946 B1 * 2/2002 Matsumoto ..... 439/164
6,475,007 B2 11/2002 Sugata

FOREIGN PATENT DOCUMENTS

JP 1-203057 7/2001

OTHER PUBLICATIONS

English Language Abstract of JP 2001–203057.

* cited by examiner

*Primary Examiner*—P. Austin Bradley
*Assistant Examiner*—X. Chung-Trans
(74) *Attorney, Agent, or Firm*—Greenblum & Bernstein, P.L.C.

(57) ABSTRACT

A cable reel includes a fixed body, configured to attach to a steering column, and a movable body, rotatably connected to the fixed body and configured to rotate interlockingly with a steering wheel. The fixed body includes a peripheral wall, which defines a cut-out portion at an upper end. A flat cable, electrically connected to the fixed body and the movable body, is wound in an annular hollow portion defined between the fixed body and the movable body. An annular elastic sheet, formed on a surface of the movable body above the hollow portion, has an outer diameter that exceeds the inner diameter of the peripheral wall. Therefore, a peripheral end of the elastic sheet extends past the inner diameter into the cut-out portion of the peripheral wall. An edge portion of the flat cable is thus covered by the elastic sheet during rotation of the movable body.

20 Claims, 3 Drawing Sheets

CABLE REEL

BACKGROUND OF THE INVENTION

1. Field of the Invention

The present invention relates to a cable reel mounted on a steering apparatus of an automobile, and more particularly, it relates to an improvement in the orientation between a movable body and a fixed body of the steering apparatus to prevent a flat cable from being pinched or wedged within an annular hollow space between the movable body and the fixed body during operation of the steering apparatus.

2. Description of Background Information

FIG. 4 depicts an exemplary conventional cable real 1 mounted on the steering apparatus of a vehicle, as disclosed, for example, in Japanese Patent Application Laid-Open No. 2001-203057. A fixed body (case) 3 is attached to a steering column side of the steering apparatus, and a movable body (rotor) 2 is attached to a steering wheel (handle) side. The fixed body 3 and the movable body 2 are rotatably connected to each other. A wound flat cable 5, which electronically connects the fixed body 3 and the movable body 2, is accommodated in an annular hollow portion of the cable reel 1 between the fixed body 3 and the movable body 2. An annular elastic sheet 4 is formed on a lower surface of a rib 2*b*, projecting radially from a lower surface of an upper wall part 2*a* of the movable body 2.

As shown in FIG. 5, in the cable reel 1, a small clearance C is provided between an outer peripheral wall 3*a* of the fixed body 3 and a peripheral end of the elastic sheet 4 in order to prevent frictional contact between the elastic sheet 4 and the fixed body 3 during rotation of the movable body 2. The outermost winding of the flat cable 5 may therefore move into the clearance C and become sandwiched between the peripheral wall 3*a* of the fixed body 3 and the peripheral end of the elastic sheet 4.

When the cable reel 1 is operated (i.e., when the movable body 2 is rotated with respect to the fixed body 3) while the flat cable 5 is between the peripheral wall 3*a* and the peripheral end of the elastic sheet 4, the flat cable 5 may become pinched or wedged, causing damage to the flat cable 5 and/or resulting in increased or fluctuating rotational torque needed to operate the steering wheel. Furthermore, an abnormal sound may be generated by the flat cable entering the clearance C.

SUMMARY OF THE INVENTION

The present invention solves the above-described problems. Accordingly, it is an object of the present invention to provide a cable reel in which a flat cable does enter a clearance formed between an annular elastic sheet of a movable body and a peripheral wall of a fixed body. The invention therefore avoids a number of negative effects during the steering operation, including, for example, preventing abnormal sounds, damage to the flat cable, and unduly increased or fluctuating rotational torque. The present invention overcomes the problems associated with the prior art, as described below.

An aspect of the present invention provides a cable reel having a fixed body and a movable body, which is rotatably connected to the fixed body. The fixed body includes a lower wall and a peripheral member, which has a first inner periphery and a second inner periphery. The first inner periphery of the peripheral member has a smaller diameter than the second inner periphery. The movable body includes an upper wall and an annular elastic sheet connected to a bottom surface of the upper wall. The upper wall of the moveable body and the lower wall of the fixed body define an annular hollow space that houses a coiled flat cable, which is electrically connectable to the fixed body and the movable body. The upper wall of the movable body and/or the lower wall of the fixed body may include a lubricating surface. A peripheral end of the annular elastic sheet extends through the annular hollow space beyond the first inner periphery, such that the flat cable is prevented from entering a space between the peripheral end of the annular elastic sheet and the fixed body during rotation of the movable member. The peripheral end of the annular elastic sheet extends less than the second inner periphery, defining a clearance between the peripheral end of the annular elastic sheet and the second inner periphery.

The peripheral member includes a wall having a cut-out portion at an upper end, the cut-out portion defining the second inner periphery. Alternatively, the peripheral member may include multiple walls. An inner surface of an innermost wall defines the first inner periphery and an inner surface of an outermost wall defines the second inner periphery. The innermost wall is longitudinally shorter than the outermost wall, so that the annular elastic sheet extends beyond the first inner periphery above the innermost wall. At least one air space is defined between the innermost wall and the outermost wall.

Another aspect of the present invention provides a cable reel that includes a fixed body, configured to be attached to a steering column, and having a peripheral wall with an inner diameter and defining a cut-out portion at an upper end. The cable reel further includes a movable body, configured to rotate interlockingly with a steering wheel, and rotatably connected to the fixed body. A flat cable is wound in an annular hollow portion defined between the fixed body and the movable body. One end of the flat cable is connectable to the fixed body and an opposite end is connectable to the movable body, enabling electrical communication between the fixed body and the movable body. An annular elastic sheet, formed on a surface of the movable body, defines a portion of the annular hollow portion and has an outer diameter greater than the inner diameter of the peripheral wall. A peripheral end of the elastic sheet, along the outer diameter, extends into the cut-out portion of the peripheral wall of the fixed body. The flat cable is therefore contained within the inner diameter of the peripheral wall and the elastic sheet during rotation of the movable body. A clearance is provided between the peripheral end of the elastic sheet and the cut-out portion of the peripheral wall of the fixed body to enable unobstructed rotation of the elastic sheet with the movable body.

Yet another aspect of the present invention provides a cable reel that includes a fixed body, configured to be attached to a steering column, and a movable body, rotatably connected to the fixed body and configured to rotate interlockingly with a steering wheel. The fixed body has peripheral walls, such that an inner surface of an inner peripheral wall defines a first inner periphery and an inner surface of an outer peripheral wall defines a second inner periphery. The cable reel includes a flat cable, wound in an annular hollow portion defined between the fixed body and the movable body. One end of the flat cable is connectable to the fixed body and an opposite end of the flat cable being connectable to the movable body, enabling electrical communication between the fixed body and the movable body. The cable reel also includes an annular elastic sheet, formed on a surface of the movable body, defining a portion of the annular hollow portion and including a peripheral end along an outer diameter. The peripheral end of the elastic sheet extends past the first inner periphery, so that an edge portion of the flat cable, contained within the inner peripheral wall, is covered by the elastic sheet during rotation of the movable body. A clearance is provided between the peripheral end of the elastic sheet and the second inner periphery defined by the outer periphery wall, enabling unobstructed rotation of the elastic sheet with the movable body.

The inner peripheral wall has a shorter length than the outer peripheral wall. Therefore, the peripheral end of the annular elastic sheet extends past the inner periphery of the inner peripheral wall, through a space defined by the shorter length of the inner peripheral wall. At least one air space is defined between the inner peripheral wall and the outer peripheral wall.

The fixed body may further include a lower wall, such that the annular hollow portion is defined, in part, by an upper surface of the lower wall. Likewise, the movable body may further include an upper wall, such that the annular hollow portion is defined, in part, by a lower surface of the upper wall. The upper surface of the lower wall and/or the lower surface of the upper wall may include a lubricating surface.

In accordance with the various aspects of the invention, even when the flat cable in the annular hollow portion is located such that an outermost portion of the flat cable contacts the inner surface of the peripheral wall of the fixed body, the peripheral end of the elastic sheet is still positioned outward from the inner surface of the peripheral wall. Thus, an upper end of the flat cable securely contacts the lower surface of the elastic sheet, reliably preventing the flat cable from entering the space between the peripheral end of the elastic sheet and the peripheral wall. It is therefore possible to prevent an abnormal sound from being generated when the cable reel is operated (i.e., when the movable body is rotated), the flat cable from being damaged, rotational torque from increasing and fluctuation amount of the rotational torque from increasing.

The various aspects and embodiments of the present invention are described in detail below.

BRIEF DESCRIPTION OF THE DRAWINGS

The present invention is further described in the detailed description that follows, by reference to the noted drawings by way of non-limiting examples of embodiments of the present invention, in which like reference numerals represent similar parts throughout several views of the drawings, and in which.

DETAILED DESCRIPTION OF EMBODIMENTS

In view of the above, the present invention through one or more of its various aspects and/or embodiments is presented to accomplish one or more objectives and advantages, such as those noted below.

Figure 1:
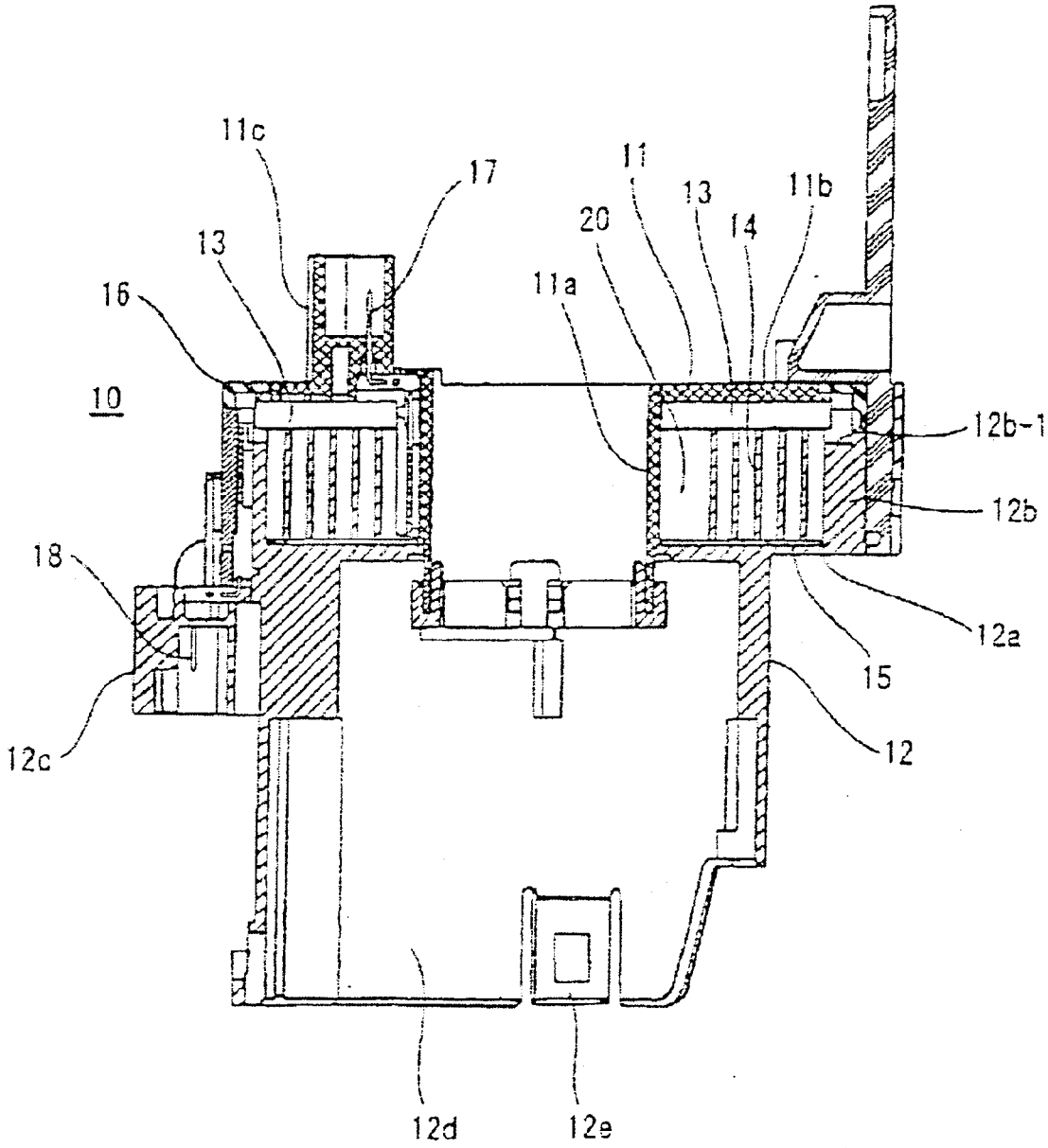
FIG. 1 is a sectional view of a cable reel, according to an aspect of the present invention.

The cable reel 10 depicted in FIG. 1 includes a movable body 11, serving as an inner cylinder, fixed to a steering wheel (not shown) side. The movable body 11 has an upper wall portion 11*b*, projecting outwardly from an upper end of an inner peripheral wall 11*a*. (The terms upper and lower are used throughout the disclosure merely to clarify the positional relationship among the various elements depicted in the figures, and are not intended to limit the orientation of these elements). The movable body 11 is rotatably connected to a fixed body 12, serving as an outer cylinder of the cable reel 10, fixed to a steering column (not shown) side. The fixed body 12 has a peripheral wall 12*b* projecting from the inner periphery of a bottom wall part 12*a*. The fixed body 12 and the movable body 11 are configured to form an annular hollow portion 20, which accommodates a wound, flat cable 14, having one end connected to the movable body 11 and the other end connected to the fixed body 12.

The flat cable 14 includes parallel conductors, made of a flexible, electrically conductive material, such as copper foil, for example, and arranged at regular intervals. The upper and lower surfaces of the flat cable 14 are laminated with an insulating material, such as a resinous film, for example.

The movable body 11 includes a connector accommodation portion 11*c*, which connects to an external electrical circuit at the steering wheel side. The movable body 11 also includes a tip-projected bus bar 17, which connects to the one end of the flat cable 14, and an annular elastic sheet 13 disposed on a lower surface of the upper wall portion 11*b*. Reference numeral 16 denotes a cover of the movable body 11.

The fixed body 12 includes a connector accommodation portion 12*c*, which connects to an external electrical circuit at a vehicle body or steering column side. The fixed body 12 likewise includes a tip-projected bus bar 18, which connects to the other end of the flat cable 14. A sectionally L-shaped cut-out portion 12*b*-1 is formed on an upper end of a thick peripheral wall 12*b* of the fixed body 12. Also, the fixed body 12 has an extended wall 12*d* extended downward and a locking part 12*e* formed at a lower end of the extended wall 12*d*. A lubricating sheet 15 is disposed on an upper surface of the bottom wall portion 12*a*, for reducing friction with the flat cable 14.

Figure 2:
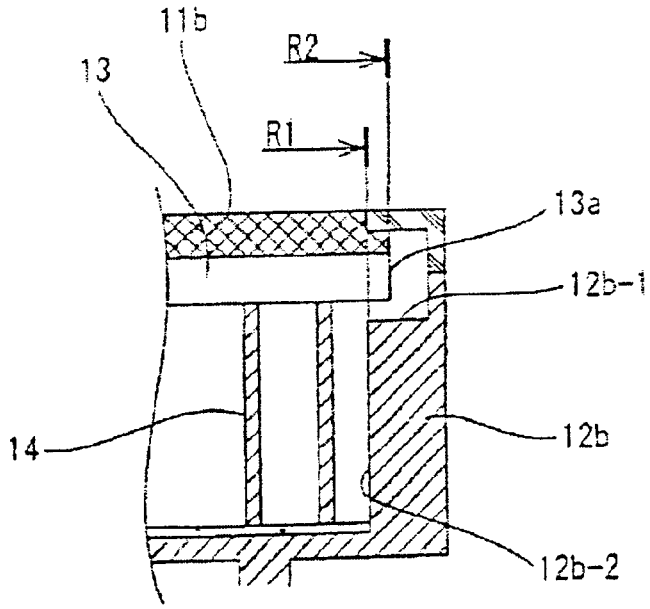
FIG. 2 is a sectional view of isolated portions of the cable reel, according to an aspect of the present invention.

As shown in FIG. 2, an inner diameter R1 of the peripheral wall 12*b* of the fixed body 12 is shorter than an outer diameter R2 of the elastic sheet 13. There is a small clearance or gap between the peripheral end 13*a* of the elastic sheet 13 and the cut-out portion 12*b*-1 formed within the upper portion of the peripheral wall 12*b*.

According to the above-described construction, the peripheral end 13*a* of the elastic sheet 13 is always positioned within the cut-out portion 12*b*-1, extending beyond the inner surface 12*b*-2 of the peripheral wall 12*b*. Therefore, even when an outermost winding of the flat cable 14, accommodated in the annular hollow portion 20, is positioned such that it contacts the inner surface 12*b*-2, the upper edge of the flat cable 14 still securely contacts the lower surface of the elastic sheet 13, reliably preventing the flat cable 14 from moving into to the space between the peripheral end 13*a* of the elastic sheet 13 and the peripheral wall 12*b*. Therefore, it is possible to prevent an abnormal sound from being generated when the flat cable 14 is wound tightly (or rewound) during operation, to prevent the flat cable 14 from being pinched or damaged, and to prevent an increase in rotational torque or fluctuation amount.

Furthermore, because of the small clearance between the peripheral end 13*a* of the elastic sheet 13 and the cut-out portion 12*b*-1 formed on the upper end of the peripheral wall 12*b*, it is possible for the flat cable 14 to contact the inner surface 12*b*-2 of the peripheral wall 12*b* within the peripheral end 13*a* of the elastic sheet 13, and still prevent the peripheral end 13*a* from interfering with the peripheral wall 12*b*.

Also, alternative forms of lubricating the flat cable 14 may be implemented without departing from the spirit and scope of the present invention. For example, instead of the lubricating sheet 15, interposed between the lower end of the flat cable 14 and the inner surface of the bottom wall portion 12*a*, a lubricating sheet or a lubricating agent may be provided on the upper surface of the elastic sheet 13.

Figure 3:
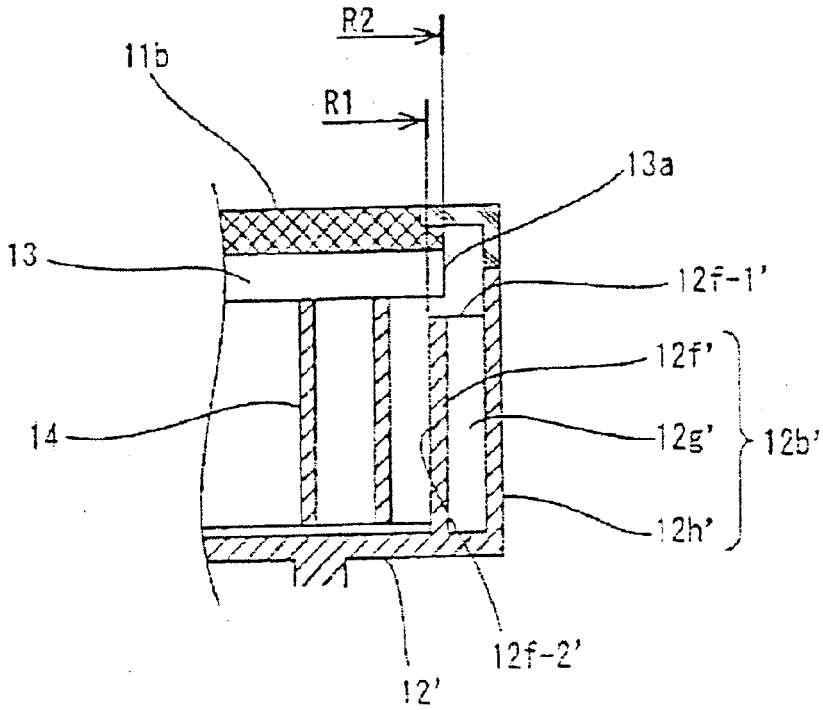
FIG. 3 is a cross-sectional view of isolated portion the cable reel, according to another aspect of the present invention.
Figure 4:
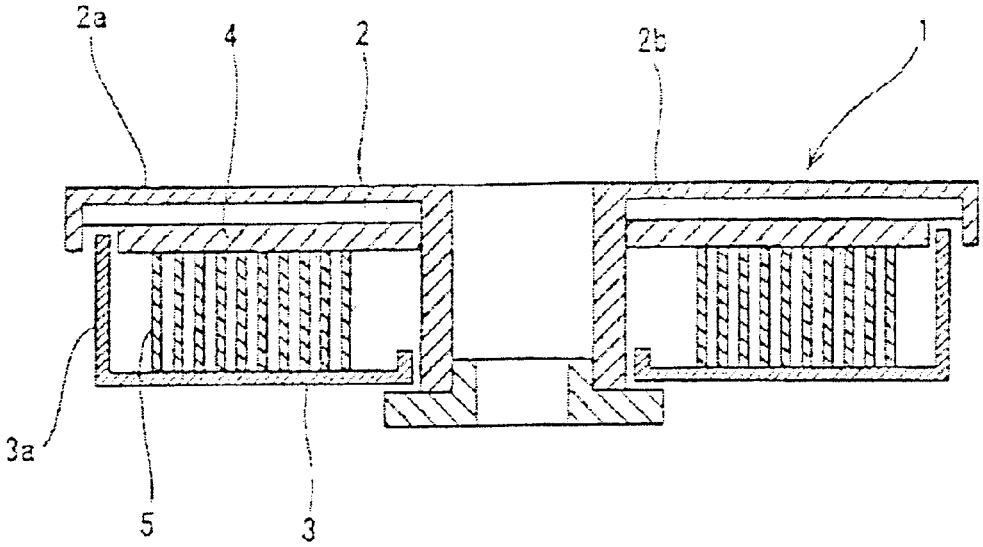
Fig. 4 Prior Art
FIG. 4 is a cross-sectional view of a conventional cable reel.
Figure 5:
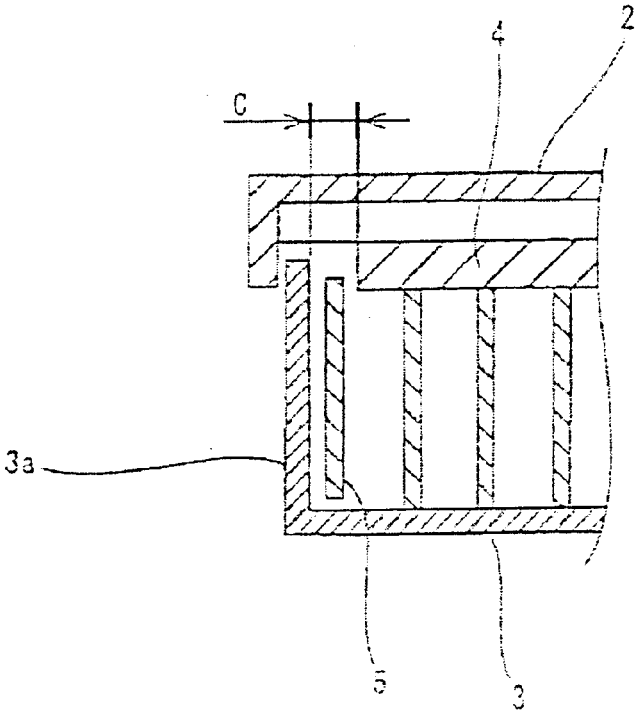
Fig. 5 Prior Art
FIG. 5 is a cross-sectional view of isolated portions of the conventional cable reel.

FIG. 3 shows a second embodiment of the present invention, in which the peripheral wall of the fixed body has a multiple-layer construction. Although FIG. 3 depicts a peripheral wall having a double-layer construction, it is understood that the peripheral wall may include additional layers (e.g., triple-layer construction) without departing from the spirit and scope of the present invention.

As shown in FIG. 3, the peripheral wall 12*b*' of a fixed body 12' has a first peripheral wall 12*f*, including an inner surface 12*f*-2' that contacts the flat cable 14, and a second peripheral wall 12*h*' positioned outwardly from the first peripheral wall 12*f*. A space 12*g*' is defined between the first peripheral wall 12*f* and the second peripheral wall 12*h*'. The first peripheral wall 12*f* is lower than the second peripheral wall 12*h*' such that the upper end of first peripheral wall 12*f*' does not reach the lower surface of the elastic sheet 13.

An inner diameter R1 of the peripheral wall 12*b*' of the fixed body 12' (i.e., the diameter defined by the inner surface 12*f*-2' of the first peripheral wall 12*f*') is shorter than an outer diameter R2 of the elastic sheet 13 (i.e., the diameter defined by the peripheral end 13*a* of the elastic sheet 13). As in the first embodiment, a small clearance is provided between the lower surface of the elastic sheet 13 and an upper end 12*f*-1' of the first peripheral wall 12*f*'. A small clearance is also provided between the peripheral end 13*a* of the elastic sheet 13 and the inner surface of the second peripheral wall 12*h*'. This enables rotational movement of the movable body 11 without frictional contact between the elastic sheet 13 and the upper end 12*f*-1' or the second peripheral wall 12*h*'.

In the above-described embodiment, the flat cable 14 is prevented from being sandwiched between the peripheral end 13*a* of the elastic sheet 13 and the peripheral wall 12*b*'. Therefore, when the cable reel 10 is operated, it is possible to prevent an abnormal sound from being generated during operation, to prevent the flat cable 14 from being pinched or damaged, and to prevent an increase in rotational torque or fluctuation amount, and further to prevent the peripheral end 13*a* of the elastic sheet 13 from interfering with the peripheral wall 12*b*' of the fixed body 12'.

The multiple-layer construction of the second embodiment provides additional advantages. For example, the peripheral wall 12*b*' of the fixed body 12' may have the same overall thickness as the solid peripheral wall 12 shown in FIGS. 1–2. However, because of the double-layer construction, which includes a space 12*g*', less material is used to obtain the same overall thickness. Thus, the material cost of the fixed body 12' is reduced. Furthermore, because the peripheral wall 12*b*' has a space 12*g*' situated between the first peripheral wall 12*f*' and the second peripheral wall 12*h*', the effective insulation of sound, generated in the annular hollow part 20, is enhanced.

As apparent from the foregoing description, even when the flat cable, accommodated in the annular hollow part, is positioned such that the outermost portion of the flat cable contacts the inner surface of the peripheral wall of the fixed body, the peripheral end of the elastic sheet extends beyond the inner surface of the peripheral wall. Accordingly, the upper end of the flat cable reliably contacts the lower surface of the elastic sheet. Also, the flat cable can not drop into a space between the peripheral end of the elastic sheet and the peripheral wall of the fixed body. The present invention therefore prevents an abnormal sound from being generated during cable reel operation, the flat cable from being damaged and the rotational torque, as well as the torque fluctuation amount, from increasing.

Although the invention has been described with reference to exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2002-187279, filed on Jun. 27, 2002, which is herein expressly incorporated by reference in its entirety.

What is claimed:

1. A cable reel comprising:

a fixed body comprising a lower wall and a peripheral member, the peripheral member comprising a first inner periphery and a second inner periphery, the first inner periphery having a smaller diameter than the second inner periphery; and a movable body, rotatably connected to the fixed body, comprising an upper wall and an annular elastic sheet connected to a bottom surface of the upper wall, the upper wall of the moveable body and the lower wall of the fixed body defining an annular hollow space housing a coiled flat cable, electrically connectable to the fixed body and the movable body;

wherein a peripheral end of the annular elastic sheet extends through the annular hollow space beyond the first inner periphery, such that the flat cable is prevented from entering a space between the peripheral end of the annular elastic sheet and the fixed body during rotation of the movable member.

2. The cable reel according to claim 1, wherein the peripheral member comprises a wall having a cut-out portion at an upper end, the cut-out portion defining the second inner periphery.

3. The cable reel according to claim 1, wherein the peripheral member comprises a plurality of walls, an inner surface of an innermost wall defining the first inner periphery and an inner surface of an outermost wall defining the second inner periphery.

4. The cable reel according to claim 3, wherein the innermost wall is longitudinally shorter than the outermost wall, such that the annular elastic sheet extends beyond the first inner periphery above the innermost wall.

5. The cable reel according to claim 3, wherein at least one air space is defined between the innermost wall and the outermost wall.

6. The cable reel according to claim 5, wherein the plurality of walls comprises two walls.

7. The cable reel according to claim 1, wherein the peripheral end of the annular elastic sheet extends less than the second inner periphery, defining a clearance between the peripheral end of the annular elastic sheet and the second inner periphery.

8. The cable reel according to claim 1, wherein the lower wall of the fixed body comprises a lubricating upper surface.

9. The cable reel according to claim 1, wherein the upper wall of the movable body comprises a lubricating lower surface.

10. The cable reel according to claim 1, the movable body further comprising an upper wall, the annular hollow portion being defined, in part, by a lower surface of the upper wall, the lower surface comprising a lubricating surface.

11. A cable reel comprising:

a fixed body, configured to be attached to a steering column, the fixed body comprising a peripheral wall having an inner diameter and defining a cut-out portion at an upper end;

a movable body, configured to rotate interlockingly with a steering wheel, rotatably connected to the fixed body;

a flat cable, wound in an annular hollow portion defined between the fixed body and the movable body, one end of the flat cable being connectable to the fixed body and an opposite end of the flat cable being connectable to the movable body, the flat cable enabling electrical communication between the fixed body and the movable body; and an annular elastic sheet, formed on a surface of the movable body, defining a portion of the annular hollow portion and having an outer diameter greater than the inner diameter of the peripheral wall;

wherein a peripheral end along the outer diameter of the elastic sheet extends into the cut-out portion of the peripheral wall of the fixed body, the flat cable being contained within the inner diameter of the peripheral wall and the elastic sheet during rotation of the movable body.

12. The cable reel according to claim 11, wherein a clearance is provided between the peripheral end of the elastic sheet and the cut-out portion of the peripheral wall of the fixed body, enable unobstructed rotation of the elastic sheet with the movable body.

13. The cable reel according to claim 11, the fixed body further comprising a lower wall, the annular hollow portion being defined, in part, by an upper surface of the lower wall, the upper surface comprising a lubricating surface.

14. A cable reel comprising:

a fixed body, configured to be attached to a steering column, the fixed body comprising a plurality of peripheral walls, an inner surface of an inner peripheral wall defining a first inner periphery and an inner surface of an outer peripheral wall defining a second inner periphery;

a movable body, configured to rotate interlockingly with a steering wheel, rotatably connected to the fixed body;

a flat cable, wound in an annular hollow portion defined between the fixed body and the movable body, one end of the flat cable being connectable to the fixed body and an opposite end of the flat cable being connectable to the movable body enabling electrical communication between the fixed body and the movable body; and an annular elastic sheet, formed on a surface of the movable body defining a portion of the annular hollow portion and comprising a peripheral end along an outer diameter, the peripheral end of the elastic sheet extending past the first inner periphery, so that an edge portion of the flat cable, contained within the inner peripheral wall, is covered by the elastic sheet during rotation of the movable body.

15. The cable reel according to claim 14, wherein a clearance is provided between the peripheral end of the elastic sheet and the second inner periphery defined by the outer periphery wall, enabling unobstructed rotation of the elastic sheet with the movable body.

16. The cable reel according to claim 14, wherein the inner peripheral wall has a shorter length than the outer peripheral wall, such that the peripheral end of the annular elastic sheet extends past the inner periphery of the inner peripheral wall through a space defined by the shorter length of the inner peripheral wall.

17. The cable reel according to claim 14, wherein at least one air space is defined between the inner peripheral wall and the outer peripheral wall.

18. The cable reel according to claim 17, wherein the plurality of walls comprises two walls.

19. The cable reel according to claim 14, the fixed body further comprising a lower wall, the annular hollow portion being defined, in part, by an upper surface of the lower wall, the upper surface comprising a lubricating surface.

20. The cable reel according to claim 14, the movable body further comprising an upper wall, the annular hollow portion being defined, in part, by a lower surface of the upper wall, the lower surface comprising a lubricating surface.

* * * * *

UNITED STATES PATENT AND TRADEMARK OFFICE

CERTIFICATE OF CORRECTION

PATENT NO. : 6,767,216 B2
DATED : July 27, 2004
INVENTOR(S) : A. Maegawa

It is certified that error appears in the above-identified patent and that said Letters Patent is hereby corrected as shown below:

Title page,
Item [56], References Cited, FOREIGN PATENT DOCUMENTS,
"1-203057" should be -- 2001-203057 --.

Signed and Sealed this

Seventeenth Day of May, 2005

JON W. DUDAS
*Director of the United States Patent and Trademark Office*